United States Patent [19]

Prestyly, Jr.

[11] Patent Number: 4,986,434

[45] Date of Patent: Jan. 22, 1991

[54] DISH AND METHOD FOR SERVING STRING-FORM FOODS

[75] Inventor: Robert V. Prestyly, Jr., Melville, N.Y.

[73] Assignee: Prestileo Industries, Inc., Jackson Heights, N.Y.

[21] Appl. No.: 794,264

[22] Filed: Nov. 1, 1985

Related U.S. Application Data

[63] Continuation of Ser. No. 583,141, Feb. 24, 1984.

[51] Int. Cl.[5] ..... B65D 1/24

[52] U.S. Cl. ..... 220/83; 220/20; D7/555

[58] Field of Search ..... 215/1 R; 220/83, 20; D7/5, 13; 23, 27; D27/29; D28/20; 206/503, 515, 519

[56] References Cited

U.S. PATENT DOCUMENTS

| | | | |
|---|---|---|---|
| Re. 24,575 | 12/1958 | Costanzo | 220/83 |
| D. 48,930 | 5/1916 | Douglass | D7/27 |
| D. 99,827 | 5/1936 | Scaman | D7/27 |
| D. 127,998 | 7/1941 | Graffe | D7/27 |
| D. 168,283 | 12/1952 | Adams | D7/27 |
| D. 196,315 | 9/1963 | Corey | D7/27 |
| D. 272,117 | 1/1984 | Lyon et al. | D7/27 |
| 1,544,972 | 7/1925 | Gebelein | D7/27 |
| 1,914,101 | 6/1933 | Bichowsky | 215/1 R |
| 2,771,755 | 11/1956 | Costanzo | 220/83 |
| 3,100,054 | 8/1963 | Rubens | 215/11 R |
| 3,229,886 | 1/1966 | Grogel | D7/23 |
| 4,067,559 | 1/1978 | McGann, Jr. | D7/27 |

FOREIGN PATENT DOCUMENTS

| | | | |
|---|---|---|---|
| 336423 | 9/1919 | Fed. Rep. of Germany | D7/23 |

*Primary Examiner*—David T. Fidei
*Attorney, Agent, or Firm*—Gregor N. Neff

[57] ABSTRACT

A dish is provided with a substantially hemispherical cavity in one side wall. The entrance to the cavity is substantially wider than the width of the tines of a standard table fork. The bowl can be used to facilitate the serving and eating of string-form foods such as spaghetti or other string-form pasta. A fork or other eating implement is inserted into the cavity and rotated so as to wind the strands of pasta on the implement to facilitate eating the pasta. The cavity guides the strands onto the tines of the fork and otherwise greatly facilitates the winding procedure.

5 Claims, 1 Drawing Sheet

DISH AND METHOD FOR SERVING STRING-FORM FOODS

This is a continuation of Ser. No. 583,141, filed Feb. 24, 1984.

This invention relates to containers and methods of preparing, serving and eating string-form foods such as spaghetti and other string-form pasta.

BACKGROUND OF THE INVENTION

The problem with eating spaghetti and other string-form foods is both well known and persistent. When such foods are eaten, the long strands do not readily form a bite-sized mass. As a result, either the strands must be cut or wound on a fork to form a bite-size mass, or the person eating the food and his eating companions must suffer through a very messy eating process. Cutting the strands is a slow, clumsy, frustrating process. When the strands are wound on a fork, they tend to wind unevenly and only with a certain degree of difficulty; the process often is clumsy and slow. Also, often too much is wound on a fork because the strands being wound are not separated from the larger mass of strands in the dish.

OBJECT OF THE INVENTION

Accordingly, it is an object of the invention to provide a container and method for facilitating the preparation, serving and eating of string or ribbon-form foods. More particularly, it is an object of the invention to facilitate the eating of such foods by making the strand winding procedure faster and easier, and by providing full or partial relief from the foregoing problems.

SUMMARY OF THE INVENTION

This object is satisfied, in accordance with the present invention, by the provision of a container with a rounded cavity in one wall, into which an implement can be inserted to wind the strands of the food around the implement. The walls of the cavity guide the strands onto the implement and greatly simplify and speed the winding process. Preferably the implement is a fork, chop sticks or the like, and the entrance to the cavity is substantially wider than the tines of the fork. Preferably, the side wall of the container forms an acute angle with the bottom wall of the container, and the cavity is a substantially hemispherical recess in the side wall. It also preferred that the entrance to the cavity be between one and one half and three times the width of the tines of the fork, and that the acute angle that the side wall makes with the bottom wall is less than forty-five degrees. Furthermore, it is preferred that the outside of the cavity portion of the side wall be co-planar with the bottom wall of the container so that it will rest on a flat surface upon which the container rests. This will prevent tipping when an implement is thrust into the cavity. The separate cavity provides a means for separating the strands being wound from the other strands so that the ball of wound strands will not be too large.

The foregoing and other objects and advantages of the invention will be set forth in or apparent from the following description and drawings.

DESCRIPTION OF THE PREFERRED EMBODIMENT

Figure 1:
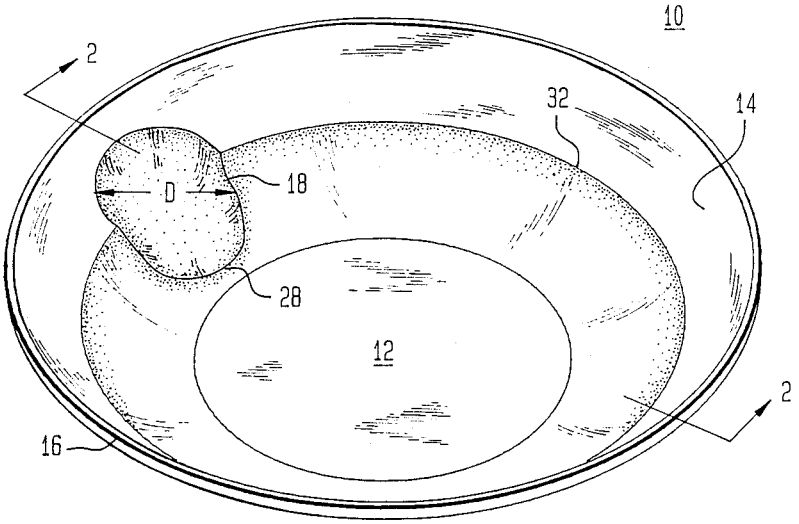
FIG. 1 is a perspective view of a container constructed in accordance with the present invention.

The container 10 shown in FIG. 1 is a circular dish or bowl, preferably made out of ceramic material, which has a bottom wall 12, a sloping side wall 14 joined with the bottom wall, and a cavity 18 in the side wall 14.

Figure 2:
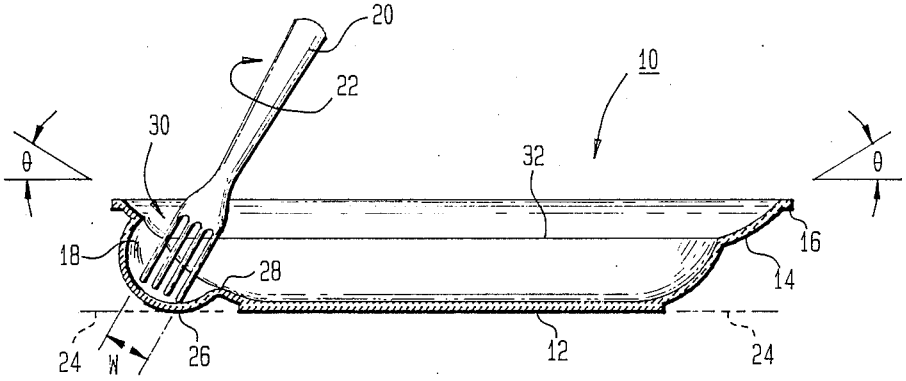
FIG. 2 is a cross-sectional view taken along line 2—2 of FIG. 1 and illustrating an eating implement in position to be used in the method of the invention.

As it is shown in FIG. 2, a standard table fork 20 is inserted into the cavity 18. The cavity 18 is substantially hemispherical in shape. The cavity 18 also can have the shape of a hemisphere which has been somewhat elongated or compressed along an axis extending in the direction in which the fork 20 is inserted into the cavity, as shown in FIG. 2. It is preferred that the cavity 18 be substantially symmetrical about such an axis. All of these shapes are deemed to be substantially hemispherical, for the purposes of this patent application. Its inlet opening has a diameter D (see FIG. 1) which is substantially greater than the width W (see FIG. 2) of the tines 30 of the fork 20.

In eating string-form foods such as spaghetti, etc., some of the food is pushed or lifted into the cavity 18, the fork 20 is inserted into the cavity and is rotated in the manner indicated by the arrow 22 in FIG. 2 until the food has been wound on the tines of the fork. Then, the fork is withdrawn and the bite-sized roll of food on the fork is eaten.

The shape of the cavity 18 appears to help guide the spaghetti or other string-form food onto the fork as it is being wound.

For best results, it is preferred that the diameter D of the entrance to the cavity 18 be no less than about one and one half times wider than the width W of the tines of the fork. For a standard table fork, the width W of the tines is approximately one inch or thereabouts. In a preferred dish made in accordance with the invention, the diameter D of the cavity 18 is approximately two inches.

Preferably, the diameter D of the cavity entrance should not become so very much larger than the width of the implement being used that it fails to serve its guiding function. Therefore, for standard table forks, a maximum diameter D of approximately three times the width W of the tines of the fork is preferred.

It also is preferred that the side wall 14 of the dish 10 make an acute angle $\theta$ with the bottom wall 12. Although the specific side wall 14 shown in the drawings is made in two sections having slightly different slopes and forming a ridge at 32, the average angle of the side wall in the vicinity of the cavity 18 should be acute. Preferably the angle $\theta$ is less than 45°. A particularly advantageous angle of approximately 30° has been selected. A relatively low angle such as this makes the cavity 18 more accessible than a higher angle would, and also facilitates manufacture of the dish.

It also is preferred that a small ridge 28 appear between the bottom 12 of the dish and the cavity 18. However this ridge is optional. The ridge 28 makes it possible to retain liquids on the bottom of the dish and keep them out of the cavity, if this is desired.

Another feature of the invention is that the lowest point 26 of the outside wall of the dish in the vicinity of the cavity 18 is co-planar with the bottom 12 of the dish. That is, the bottom of the dish and the point 26 are in the same plane 24, and both rest on the flat surface upon which the dish rests. By this means, additional support is provided for the cavity portion 18 to prevent the dish 10 from tipping when the fork 20 or other implement is thrust into the cavity 18 during a winding operation.

With a small change in the outside shape of the bulge formed in the side wall 14 by the cavity 18, the dish 10 can be made nestable with other dishes of the same type to facilitate compact storage of the dishes. The change involves making the cavity 18 slightly less than half a sphere, or making it slightly oblate, so that the entrance of each cavity 18 is wide enough to receive the bulge from another dish stacked on top of it, and the bulge will nest snugly within the cavity 18 below it.

The invention is believed to be useful not only with spaghetti, but with other forms of string-form foods such as linguini, vermicelli, fusilli, egg noodles, Japanese noodles, Chinese noodles, fettucine, etc. These foods can be served plain, or with a sauce, or in a soup, or in many other ways.

A variety of eating implements can be used. Included, are forks such as the fork 20 shown in FIG. 2, chop sticks, and a variety of implements around which the food strands can be wound.

Although standard ceramic chinaware materials are preferred for the dish, it can be made of stainless steel, or pewter, or glass, or plastic or stoneware, or any other material suitable for use in serving foods.

It can be seen from the foregoing that the above-described invention meets the objectives set forth above admirably. The container of the invention provides a simple, relatively inexpensive container for greatly facilitating the preparation, serving and eating of string-form foods. The cavity in the container guides the strands of food onto an implement inserted into it so as to make the winding process much faster, easier and more graceful.

The above description of the invention is intended to be illustrative and not limiting. Various changes or modifications in the embodiments described may occur to those skilled in the art and these can be made without departing from the spirit or scope of the invention. The term "string-form", as used herein, includes foods which have elongated strands, no matter what their cross-sectional shapes might be. The "substantially hemispherical" shape of the cavity 18 includes somewhat oblate or less than hemispherical shapes for nesting or other purposes, within the spirit of the invention.

We claim:

1. A serving container or dish for string-form foods, said container comprising a bottom wall, at least one side wall joined with said bottom wall to form a container, said container having a cavity in said side wall, said cavity being of substantially hemispherical shape and being adapted to receive one end of an eating implement around which strands of said string-form foods can be wound, and being shaped to guide said strands onto said implement when said strands are being wound thereon, said cavity being located adjacent said bottom wall of said dish, in which the wall portion forming said cavity bulges outwardly, the opening of said cavity and the exterior of said wall portion of one dish fits downwardly into the cavity of a dish below it when said dishes are stacked on top of one another.

2. A container as in claim 1 in which the bulging side-wall of said dish and said cavity are shaped to nest with the same portions of other dishes stacked on top of said dish so that said dishes are nestable.

3. A serving container or dish for string-form foods, said container comprising a bottom wall, at least one side wall joined with said bottom wall to form a container, said container having a cavity in said side wall, said cavity being of substantially hemispherical shape and being adapted to receive one end of an eating implement around which strands of said string-form foods can be wound, and being shaped to guide said strands onto said implement when said strands are being wound thereon, said cavity being located adjacent said bottom wall of said dish, in which the lowermost portion of the outside surface of said container at the location of said cavity bulges outwardly from the remainder of said dish and is substantially co-planar with the outside surfaces of said bottom wall so as to minimize tipping of said container under the force of an eating implement inserted into said cavity and bearing against the inside wall in said cavity.

4. A string-form pasta dish comprising a bottom wall, a side wall joined with said bottom wall and extending upwardly therefrom at an acute angle in at least one section, a substantially hemispherical recess in said one section of said side wall, said recess being adapted to receive one end of an eating implement about which said string-form pasta can be wound, said recess being located adjacent said bottom wall of said dish, in which the outside surface of said side wall in the vicinity of said cavity bulges outwardly and downwardly so that its bottom outside surface is substantially co-planar with the outside surface of said bottom wall so as to form a support for said one section of said side wall to deter it from tipping.

5. A method of preparing string-form food for eating, said method comprising the steps of (a) providing a dish with a bottom wall and a side wall with a rounded recess in said side wall adjacent and laterally spaced from said bottom wall, said recess being large enough to receive one end of an eating implement around which strands of said food can be wound, (b) placing said food in said dish, (c) moving said food laterally from said bottom wall into said recess;

(d) inserting one end of said eating implement into said recess, (e) rotating said implement to wind said strands on said implement, and (f) removing said implement with the strands wound on it for eating, in which said recess is substantially hemispherical and has a bottom wall portion substantially co-planar with said bottom wall of said dish, and including a relatively short barrier between said bottom wall of said dish and said recess, said food moving step including sliding said food over said barrier.

* * * * *